US010016057B1

(12) United States Patent
Arnautovic et al.

(10) Patent No.: US 10,016,057 B1
(45) Date of Patent: Jul. 10, 2018

(54) DRAWER FOR WALL MOUNTED STORAGE SYSTEM

(71) Applicant: Elfa International AB, Vastervik (SE)

(72) Inventors: Fikret Arnautovic, Vastervik (SE); Peter Nilsson, Vastervik (SE)

(73) Assignee: Elfa International AB, Vastervik (SE)

( * ) Notice: Subject to any disclaimer, the term of this patent is extended or adjusted under 35 U.S.C. 154(b) by 0 days.

(21) Appl. No.: 15/465,592

(22) Filed: Mar. 21, 2017

(51) Int. Cl.

| | |
|---|---|
| ***A47B 88/43*** | (2017.01) |
| ***A47B 88/944*** | (2017.01) |
| ***A47B 95/00*** | (2006.01) |
| ***A47B 96/02*** | (2006.01) |
| ***A47B 96/06*** | (2006.01) |

(52) U.S. Cl.
CPC ..... *A47B 88/43* (2017.01); *A47B 88/944* (2017.01); *A47B 95/008* (2013.01); *A47B 96/027* (2013.01); *A47B 96/061* (2013.01)

(58) Field of Classification Search
CPC ..... A47B 88/43; A47B 88/944; A47B 88/402; A47B 88/407; A47B 88/956; A47B 2088/951; A47B 2088/952; A47B 2088/953; A47B 2088/954; A47B 2088/955; A47B 87/00; A47B 96/008; A47B 96/027; A47B 96/061
USPC ..... 312/246, 348.4, 330.1, 334.7
See application file for complete search history.

(56) References Cited

U.S. PATENT DOCUMENTS

| | | | | | |
|---|---|---|---|---|---|
| 2,562,290 | A * | 7/1951 | Backus | A47B 88/941 | 312/330.1 |
| 2,661,993 | A * | 12/1953 | Little | A47B 87/00 | 211/134 |
| 3,278,248 | A * | 10/1966 | Torok | A47B 88/90 | 312/308 |
| 4,312,086 | A * | 1/1982 | Bianco | A47B 83/00 | 108/108 |
| 4,735,470 | A * | 4/1988 | Falk | F25D 25/021 | 312/246 |
| 4,944,566 | A * | 7/1990 | Carper | F25D 25/02 | 312/246 |
| 5,074,009 | A * | 12/1991 | Simonton | A47B 95/02 | 16/416 |
| 5,551,772 | A * | 9/1996 | Keffer | A47F 7/02 | 206/6.1 |
| 6,428,128 | B1 * | 8/2002 | Henriott | A47B 21/06 | 312/334.12 |
| 6,497,185 | B1 * | 12/2002 | Barrett | A47B 96/025 | 108/108 |
| 9,131,771 | B2 * | 9/2015 | Lindblom | A47B 88/0455 | |
| D766,634 | S | 9/2016 | Nilsson et al. | | |

(Continued)

*Primary Examiner* — Daniel J Troy
*Assistant Examiner* — Timothy M Ayres
(74) *Attorney, Agent, or Firm* — Hubbard Johnston, PLLC

(57) ABSTRACT

In a wall-mounted storage system comprising standard components, from which to assemble and install, and improved drawer. The drawer has having a drawer frame with two side rails, a back, and a front, metal bracket extending between and connecting each of the two side rails, defining an opening into which an open topped container may be inserted and supported by the frame. The drawer has a drawer front having a finished outer-facing surface and an inside surface for attaching to the metal bracket, the inside surface having formed thereon a recess extending from a top edge of the drawer front to at least the top edge of the metal bracket.

20 Claims, 2 Drawing Sheets

(56) References Cited

U.S. PATENT DOCUMENTS

| | | | | |
|---|---|---|---|---|
| 2002/0043914 | A1* | 4/2002 | Munday | A47B 88/487<br>312/334.7 |
| 2015/0296982 | A1* | 10/2015 | Chen | A47B 88/43<br>312/334.8 |

* cited by examiner 38
49
22
44
46
37
50
48
54
52
60
62
10

DRAWER FOR WALL MOUNTED STORAGE SYSTEM

FIELD OF INVENTION

The invention relates generally to the field of adjustable, wall-mounted shelving and storage systems.

BACKGROUND

Conventional adjustable, wall mounted shelving and storage systems typically comprise at least two, vertical standards mounted to a wall a predetermined distance apart, and at least one cantilevered bracket attached to each standard. A cantilevered bracket is attached to the standards by inserting one or more hooks, located on one end of the bracket, into slots formed in the standard. The hook can be formed using a tab with a notch in a bottom edge of the tab that fits over a bottom edge of a slot into which the tab is inserted. To make the positions of the shelves adjustable, each standard has a plurality of slots.

Although the cantilevered brackets are typically used to support shelves, they can also be used to support containers, such as wire baskets, mesh baskets, and plastic tubs positioned between the brackets, with a lip or other horizontally extending ledge surrounding the container resting on the brackets or on a frame mounted between the brackets. Furthermore, containers can be supported by a sliding frame to form a "hanging drawer," which can be pulled out or extended.

For example, the DÉCOR drawer frame from Elfa International AB, is supported by two cantilevered brackets, which are attached to vertical standards mounted on a wall. The drawer frame comprises a wooden frame forming an opening into which a container is dropped. Examples of containers include wire baskets, mesh baskets, and plastic containers. The frame is mounted between two brackets with drawer slides to allow the frame with the container to be moved between retracted and extended positions.

SUMMARY

Described below are various improvements and features to a drawer assembly and shelf for a wall-mounted storage system that enable it to be, if desired, assembled into a wide range of possible configurations and that enable installations to have, if desired, a substantially continuous front surface with a uniform finish for more easily blending with a home environment.

In a drawer frame having two side rails and a back rail for supporting a container, a feature of an exemplary embodiment of a drawer frame assembly for a wall mounted storage comprises a front bracket extending between and connecting to each of the two side rails capable of supporting drawer fronts extending across the front of the frame and having different standard heights, thus allowing the frame to be used with drawer fronts different heights that allow for containers of different depths to be used within the wall mounted storage system while also allowing the drawer assemblies to be placed adjacent to each other in a manner that creates, if desired, a uniform, relatively continuous appearance when installed.

According to another feature of this exemplary embodiment, a recess may be formed on the inside surface of a drawer front for accommodating a front lip of a container when inserted into the opening of the drawer frame having relatively thin front bracket, thereby giving the advantage, if desired, of reducing the required overall depth of the drawer assembly for a container of a give depth.

According to a different feature of this exemplary embodiment of a wall mounted storage system, the system includes shallow brackets for attaching to standards for supporting a shelf over a drawer assembly supported by brackets attached to the standard. The shallow brackets allow for a drawer assembly to be positioned on brackets immediately underneath the shelf, thereby reducing the space between the drawer assembly and the shelf and thus also the opportunity for users to overfill the container, which would put additional weight and stress on the system when installed. The closer spacing of the shelf and the drawer assembly also allows for standard drawer fronts to be used for the drawer assemblies wherever they are placed within an installation of the storage system, while permitting the use of a relative a small apron extending down from a front edge of the shelf to the top of a standard drawer front to give an installed system a continuously uniform appearance.

These and other features and advantages of an exemplary embodiment of a drawer assembly for a wall mounted storage system are described below.

DETAILED DESCRIPTION OF EXEMPLARY EMBODIMENTS

In the following description, like numbers refer to like elements.

Figure 1:
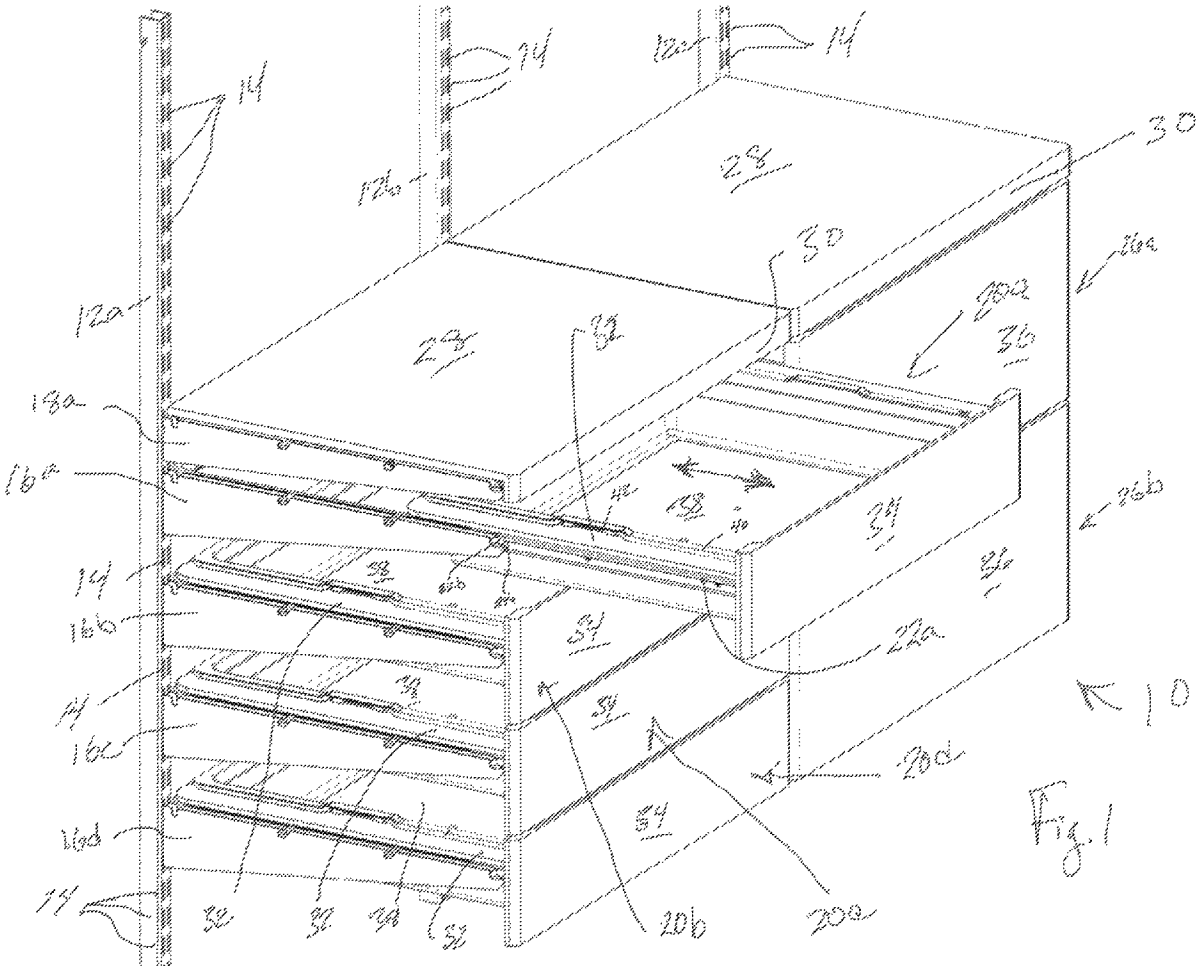
FIG. 1 is a perspective view of one example of an assembled wall mounted storage system having two sets of drawers and shelving presenting a uniform, finished appearance.

FIG. 1 is a non-limiting example of an installation of a wall-mounted storage system comprising standardized components, meaning components with standard dimensions, from which to assemble and install on a wall a storage system with any number of possible different configurations and sizes, depending on the storage preferences and objectives of the installer and available space. The following description will reference to this example. However, the features of the subject matter described below are not limited to the illustrated configuration of storage components. Furthermore, although some features described below may have advantages specific to the embodiments of a wall-mounted storage system like the one shown in the accompanying figures, many features can be adapted to advantage to other wall-mounted shelving or storage systems having standardized components for assembling into different configurations.

A wall-mounted storage system of the type illustrated in FIG. 1 typically comprises at least two, spaced-apart vertical standards that are mounted on the wall, such as by screws, hanging them from a track, or in another manner capable of supporting the intended weight capacity of the system on the wall. In the illustrated example, the standards are hung from a horizontal track (not shown) located along the top of the wall to allow for adjustment of the placement of the standards to fit interchangeable storage components made of a predetermined width. Interchangeable components of different predetermined widths could also be used in the same system. Components of all the predetermined widths could be used with each other by adding additional standards to create the necessary spacing to accommodate the different widths.

To support a shelf, container or other structure for storing items, the system is assembled on the wall by attaching the standards to the wall, and connecting at least one cantilevered bracket to each standard at the same height. Each of the standards typically include regularly spaced slots, into which hooks or tabs located on the end of the brackets are inserted, to allow the brackets to be mounted or connected to the standard at a position based on the purposes for which the brackets will be used, the needs of the user or the space in which it is installed. The brackets may subsequently be moved and attached to different positions on the standards.

The non-limiting example illustrated in FIG. 1 has three, spaced apart vertical standards 12 (the three instances are numbered 12*a*, 12*b*, and 12*c*) mounted on the wall. Each standard 12 includes at least one column of slots into which one or more tabs or hooks disposed on the end of a bracket can be inserted to support the bracket in a cantilevered fashion on the standard. In the illustrated example, each standard has two columns of slots, with each slot being paired with an adjacent slot in the adjacent column. The standards thus have a plurality of pairs of slots 14 arranged at regular intervals along the length of the standard to allow for selectively attaching brackets to any number of positions along the standard. The slots are arranged in side-by-side pairs because the brackets that are used for the system include a pair of side-by-side hooks (formed by notched tabs) extending from the end of bracket, where it connects to the standard, for inserting into a pair of slots. As compared to brackets that use a single hook, brackets using a pair of side-by-side hooks are more laterally stable and tend not to swing from side to side. However, in alternative embodiments, a bracket with a single hook could be used.

Four, three-slot brackets 16 (the four instances are numbered 16*a*, 16*b*, 16*c* and 16*d*) and a two-slot bracket 18 (the one visible instance is numbered 18*a*) can be seen mounted or connected with standard 12*a* in FIG. 1. Each three-slot bracket has an end abutting the standard, where the bracket connects with the standard, that covers, at least partially, three pairs of slots when it is attached to the standard. In this example, each three-slot bracket 16 abutting also includes a lower pair of stabilizing tabs (without notches) that are inserted into the second of the three slots occupied by the bracket. The shallower, two slot bracket 18 covers only two pairs of slots. The short or shallow brackets allow positioning of a drawer one position or step closer to the shelf than would otherwise be possible with a three-slot bracket. For each of the brackets visible in the FIG. 1, there is a corresponding bracket mounted at the same vertical location on standard 12*b*, which cannot be seen. However, on standard 12*c* there are corresponding brackets in the same vertical location only for brackets 16*a*, 16*c*, and 18*a*.

The wall-mounted storage system includes at least one type of drawer 20 with a standard (predetermined) width and length to allow a group or set of drawers to be easily grouped together as a set of vertically stacked drawers. For example, in the configuration shown in FIG. 1, brackets 16*a*, 16*b*, 16*c* and 16*d* on standard 12*a*, and their corresponding brackets on standard 12*b*, support a set of four drawers 20 (the four instances of which are numbered 20*a*, 20*b*, 20*c*, and 20*d*.) The drawers move between an extended (open) position and a retracted (closed) position. Drawer 20*a* is shown in an extended position; the remaining drawers are shown in a retracted or closed position. Each of the drawers are, in this example, are mounted between pairs of brackets using two drawer slides, one on each side.

A typical drawer slide suitable for mounting on a side of a drawer will include, for example, two complementary tracks. One track is attached to a side of the drawer and the other, complementary track is attached or supported on an adjacent bracket. In FIG. 1, one drawer slide can be partially seen. The slide comprises a track 22*a* that is attached to the side of drawer frame 32. The other part of the drawer slide, a complimentary track 22*b* and a roller 24*b* that rides in slide track 22*a*, are mounted on bracket 16*a*. None of the other slides used to mount the drawer frames of drawers 20*b*, 20*c* and 20*d* are visible, but they are substantially similar. Examples of types of suitable drawer slides include roller and ball bearing slides. Other types of drawer slides could be used and adapted to the system, as well as other means or mechanisms for supporting the drawer on cantilevered brackets while allowing it to be extended and retracted. The track 22*b* includes, for example, tabs that are used to hang the track to a side edge on the bracket. However, the tracks can be attached to or supported by the bracket in other ways. Furthermore, the track for the slide can be integrally formed with the bracket. The bracket-mounted tracks for both slides of a drawer can also be made as a single assembly, an example of which is a u-shaped assembly with a back piece that connects the two tracks, which installs or snaps quickly on the two brackets and accommodates the drawer when retracted.

The wall-mounted storage system may include more than one standard drawer type. Drawer 26 (the two instances of which in FIG. 1 are numbered 26*a* and 26*b*) is an example of a deeper (or taller) drawer that has the same length (back to front) and width as drawer 20. Drawer 26 is mounted between two brackets in a manner like drawers 20. The brackets cannot be seen in FIG. 1. They would be mounted at the same level as brackets 16*a* and 16*a* on standard 12*c*. They share brackets corresponding to brackets 16*b* and 16*d* that are mounted on standard 12*b* for supporting drawers 20*b* and 20*d*.

Drawers 20 and 26 are intended to be examples of a modular approach to accommodating drawers of different depths having drawer fronts 34 and 36 that closely fit together to give the appearance of a continuous, uniform surface with a pleasing aesthetic. The depths of drawers are made to correspond to different numbers of positions on the standards. In this example, the relatively shallow drawers 20*a*-20*d* each requires 4 slots and thus occupies 4 positions on a standard. The deeper drawer requires 8 slots. Furthermore, a drawer type with a different standard width, but the same length (back to front) could be included in the wall-mounted storage system. Mixed width drawers could be accommodated by an installation with three or more standards, with the distances between the first and second corresponding to the first standard width, and the distance between the second and third standing corresponding to the second standard width.

As previously mentioned, the wall-mounted storage system may also include standard shallow brackets 18, the single, visible instance of which is numbered 18*a* in FIG. 1 attached to standard 12*a*. The same shallow bracket 18 is attached in the same positions on standards 12*b* and 12*c*, though those instances are not visible. A pair of shallow brackets can be used to support a shelf 28 to cover a top of a drawer that would otherwise be exposed (for example, the top drawer in each of the two stacks of drawers 20*a*-20*d* and 26*a*-26*b* in FIG. 1). These shelves are, in the example, made of wood, but could be made of other materials, or a combination of materials. Each of the shelf incorporates, in the illustrated embodiment, a short front apron or flange 30 that hides the ends of the shallow brackets 18, on which it is supported. Each shelf 28, with the brackets 18, occupies two positions (rows of slots) on the standards 12*a*-12*c*, and thus allow positioning of a bracket 16 for a drawer immediately underneath the shelf at the next adjacent position immediately below. The apron extends down far enough to nearly meet, with a relatively small gap to accommodate manufacturing and assembly tolerances, a top edge of the immediately adjacent drawer front. In one embodiment, the gap is between 2 and 12 mm wide. In another embodiment, the gap is approximately 6 mm wide. In the configuration of FIG. 1 these immediately adjacent drawer fronts are drawer fronts 34 and 36 of drawers 20*a* and 26*a*. The material and the finish of the apron 30 could match drawer fronts 34 and 36 of the drawers to allows for a more uniform appearance of the assembled wall-mounted storage system, with a continuous and consistent appearance of the assembly.

Figure 2:
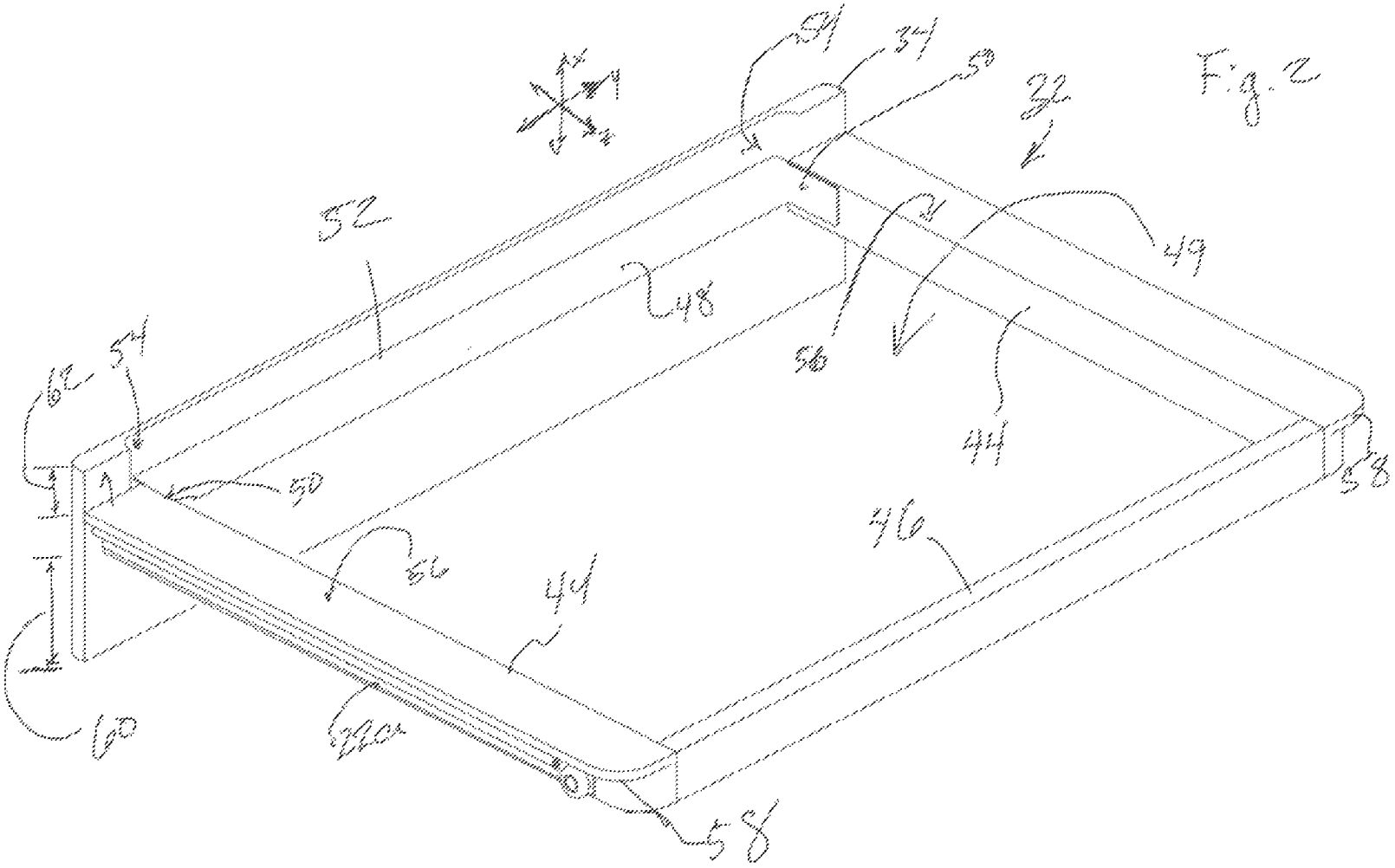
FIG. 2 is a perspective view of a drawer frame attached with a finished draw front for use in the system of FIG. 1.

Referring now also to FIG. 2, each drawer 20 and 26 is comprised of a standard drawer frame 32, to which drawer front 34 or 36 is attached. Each drawer front has a standard width and one of two standard height. FIG. 2 illustrates a standard drawer frame 32 to which is attached to a standard drawer front 34 of a predetermined height and width. Drawer front 36 could, instead, be attached to the drawer frame. In FIG. 1 each drawer 20*a*-20*d* comprises a drawer frame 32 and a drawer front 34, a rear, perspective view of which (without a container) are shown in FIG. 2. Each drawer 26 also has a drawer frame 32, but drawer front 36 of a larger standard height.

Each drawer 20 and 26 includes a container suspended from the frame to form a bottom and four sides of a drawer. Each of the drawers 20*a*-20*d* includes a container 38 of standard dimensions—width, length and height (or depth)—that is inserted into an opening in the drawer frame 32 of each of the drawers 20*a*-20*d*. Each drawer 26, which has a taller drawer front 36, can accommodate a container that is twice as deep. The containers for the wall mounted storage system, like the drawer frames, come in one or more standard dimensions. Each container has four sides, a bottom, and an open top. If more than one standard container is offered as in the wall-mounted storage system, the length (back to front) of each container is preferably the same. In this example, two containers of the same width are part of the wall-mounted storage system, one shallow and one deeper.

Each of the containers has a lip 40 or similar structure around at least a part of its outer periphery, near a top edge of the sides that define the opening, that allows the container to be dropped into and supported on the drawer frame 32. Although the lip extends continuously around the periphery of the container in the illustrated example, alternative embodiments need not have a continuous lip. A portion 42 of the lip may, optionally, be offset or raised from the frame to facilitate removal of the container from the frame. The walls and bottom of container 38 are solid, and made from plastic, wood or fabric. A container made of mesh or wire, or a combination of materials, could also be used.

Each drawer frame is comprised of two side rails 44, and back rail 46 and a front bracket 48 joined together to form a rectilinear shape with at least straight outside edges on the sides and inside edges defining center opening 49. The center opening has, in this example, a rectilinear shape formed by straight, inside top edges and surfaces of the side and back rails and front bracket. It has a standard or predetermined width and length, into which a container having a rectilinear shape can be dropped and supported. However, the drawer frame could, if desired, be formed without straight inside edges for supporting a container of a different or non-rectilinear shape. The side and back rails could be made of any solid material, including wood or plastic, but they are made of wood in the illustrated example.

The front bracket 48 of the drawer frame 32 has disposed at each end a right-angle support 50 (only one is visible in FIG. 1) for attaching the bracket to the side rails 44. Each support has a flange that allows for it to be attached to an inside edge of a side rail using a fastener (for example, a screw), or by another means. The right angles could be integrally formed by, for example, bending the ends a sheet of metal used to make the bracket to form the right angles. But other methods could be used to form them. The right angle supports 50 could, alternatively, be made and attached to the bracket separately. In alternative embodiments, other means of connecting the front bracket 48 to the side rails could be used, including for example attaching the bracket directly to a different surface, such as a front-facing surface, of the side rails. However, such methods of attachment might not offer the full advantage of the bracket as shown.

Screws are used to attach the bracket 48 to the side rails, but other fasteners could be used. The drawer front 34 or 36 of the drawers are attached to the bracket 48 using screws or other fasteners. This allows standard dimensioned drawer fronts to be made in a range of materials and/or finishes and then easily attached to the drawer frame, either at the point of assembly of the drawer frame as a component for resale, or by a purchaser assembling a purchased drawer frame and drawer front. Using removable fasteners, such as screws, or other ways of removably-attaching the drawer fronts allows relatively easy retrofitting of a different drawer fronts if different finishes or materials are desired. The attachment points for the fasteners, such as the screws, may, if desired, be located inwardly of the side rails to allow for easier assembly.

The bracket 48 is, in a preferred embodiment, made of material that allows for it to be made thinner as measured along the Z-axis (front to back of the drawer) that is indicated in the coordinate frame next to the figure, than as compared to the side rails, and yet provide adequate strength. For aesthetic reasons, the side rails may be formed from the same or similar material wood, for example—as the drawer front. In a preferred embodiment, the bracket material is made of a metal. For example, it can be made from relatively thin sheet of metal so that it takes up little space, as measured along a Z-axis (front to back of the drawer), that has a height or dimension along the X-axis (bottom to top of the drawer) that gives sufficient strength to resist bending in that direction, as well as to resist torsional forces that might be, for example, exerted by a larger drawer front or pulling on the drawer front, and yet is small enough to allow attachment of a range of standard drawer front heights, from relatively small to relatively large, such as those exemplified by drawer fronts 34 and 36. The bracket 48 may, optionally, also include a flange or fold 52 that extends at a right angle from the bracket in the direction indicated by the Z-axis, toward the front of the drawer. Flange 52 gives additional strength to the metal bracket, helping it to resist bending in the Z-direction, front to back. The flange is also even with top surfaces 56 of side rails 44. It may support a lip of a container that is inserted into opening 49.

A recess 54 is milled or otherwise formed on a back side of drawer front 34 to accommodate a front lip to accommodate a front lip of a container when it is inserted into opening 49 and, if present, the flange 52. The recess 54 extends from the top of the drawer far enough, in the direction of the X-axis, to form either a ledge even with the top surfaces of rails 44 on which a lip of a container could rest or, as in this example, far enough to accommodate the flange 52. It preferably also has a width equal to that of the lip on the container that would be accommodated by the recesses. With the recess, the length of the drawer (measured along the Y-axis) is shorter and more compact.

The top surfaces of side rails 44, back rail 46, and metal bracket 48 are, in this example, straight and even with each other, forming a substantially continuous horizontal surface for supporting a container within the opening for allowing, if desired, the load from the container to be evenly distributed around the lip and the frame. However, the lip of the container need not continuously contact the all the top surfaces, or be continuous around the periphery of the container. The container could be, for example, supported (in contact with the drawer frame) only on the left and right sides, on the back and front sides, or partially on each of the sides. Furthermore, top surfaces of the rails and bracket need not be, in alternative embodiments straight and even, if the container is supported within the opening 50 in a stable position.

Each of the two side rails 44 preferably have straight outside surfaces, which are obscured in the figures, on which are mounted a track of a drawer slide that is used to mount the drawer to one of the cantilevered brackets 16. Only one track 22*a* is visible in FIG. 2, but the other side also has a track 22*a*. Each side rail 44 has a portion that forms a flange 58 that extends over the top of the tracks 22*a*. The flange can be integrally formed in the side rails by removing or milling each rail 44 to form a groove or recess in which the track 22*a* can be mounted. Alternatively, the ledge can be separately formed and attached to the rails 44.

The width of the drawer fronts 34 and 36 preferably extend beyond the side rails 44 to cover or obscure the tracks 22*a* for the slides, or other mounting mechanism that allows for the draw to be extended or retracted, and to fit more closely with drawer fronts on adjacent drawers to create a set of drawers and shelves with clean and uniform look of solid wood or other material. The result can be seen best in FIG. 1, where the sides of drawers 20*a*-20*d* fit closely with the adjacent sides of drawers 26*a* and 26*b*, with only a relatively small gap between them to accommodate manufacturing and assembly tolerances and avoid interference.

Each drawer front 34 and 36 extends from the frame 32, far enough downwardly, as indicated by dimension line 60 (FIG. 2), to cover or obscure the end of a container (not shown in FIG. 2) supported by the drawer frame 32 to which it is attached, and to fit closely with a top edge of a drawer front for a drawer positioned immediately below it. Similarly, each drawer frame extends upward from the drawer frame, as indicated by dimension line 62, a distance that covers the gap between the top of the drawer frame 32 or the container that rests on it, and a bottom of a drawer or shelf immediately above it. This can be seen, for example in FIG. 1, between the bottom of drawer front 34 of drawer 20*b* and a top edge of drawer front 36 of the next adjacent drawer 20*c*, as well as between a top edge of drawer front 36 of drawer 26*a* and a bottom edge of apron 30 of the shelf 28 immediately above it.

The foregoing description is of exemplary and preferred embodiments. The invention, as defined by the appended claims, is not limited to the described embodiments. Alterations and modifications to the disclosed embodiments may be made without departing from the invention. The meaning of the terms used in this specification are, unless expressly stated otherwise, intended to have ordinary and customary meaning and are not intended to be limited to the details of the illustrated or described structures or embodiments.

What is claimed is:

1. A wall mounted storage system comprising:

a drawer frame, comprising two side rails that are spaced apart, each side rail having a front end and a back end;

a back rail between the two side rails connecting to the back end of each of the two side rails; and a bracket extending between and connecting to each of the two side rails; and wherein the two side rails, back rail and bracket define a rectilinear shaped opening into which an open topped container may be inserted and supported by the frame; and a drawer front having a finished outer-facing surface and an inside surface for attaching to the bracket, the drawer front extending to or beyond the outside edges of each side rail, and extending below and above bracket, the inner-facing surface of the drawer front has formed therein a recess extending from a top edge of the drawer front down to at least a top of the bracket for accommodating a lip of a container when placed within the opening, wherein the recess only partially extends into the drawer front from the inner-facing surface.

2. The wall storage system of claim 1 further comprising:

two standards for mounting to a wall;

a pair of cantilevered brackets, one for each standard; and drawer slides for mounting the drawer frame to the pair of brackets.

3. The wall storage system of claim 1, further comprising:

two standards for mounting to a wall, each of the two standards having a plurality of predefined positions at which a cantilevered bracket may be attached;

a first pair of cantilevered brackets for mounting the drawer frame, a different one attached each of two of the two standards;

a second pair of brackets; and a shelf for mounting on the second pair of brackets, the shelf having a front apron extending from a front edge of the shelf downward a distance to at least partially cover the second pair of brackets.

4. The wall storage system of claim 3, wherein each one of the first pair of cantilevered brackets each occupies, when attached to either of the two standards, a predetermined number of the predefined positions, and each one of the second pair of cantilevered brackets occupies less than the predetermined number of predefined positions when attached to either of the at least two standards.

5. The wall storage system of claim 4, wherein, when the first pair of cantilevered brackets is connected to the two standards immediately below the second pair of brackets, the drawer frame is mounted on the first pair of brackets, and the shelf is mounted on the second pair of brackets, the drawer front extends upwardly to fit closely with a bottom edge of the apron to establish a finished appearance.

6. The wall storage system of claim 1, wherein the bracket has a thin, cross-sectional thickness, as measure from front to back, as compared to the side rails.

7. The wall mounted storage system of claim 1, wherein bracket is made of metal.

8. The wall mounted storage system of claim 1, wherein the side rails are made of wood.

9. The wall mounted storage system of claim 1, wherein the recess extends at least to the outer edges of the bracket.

10. The wall mounted storage system of claim 1, wherein each of the two side rails has an inside edge, and the recess extends between the inside edge of each of the two side rails.

11. A wall mounted storage system a comprising:

first and second drawer frames, each drawer frame comprising:

two side rails that are spaced apart, each side rail having front end and a back end;

a back rail between the two side rails connecting to the back end of each of the two side rails;

a metal bracket extending between and connecting each of the two side rails, the two side rails, back rail and metal bracket defining a rectilinear shaped opening into which an open topped container may be inserted and supported by the frame; and a drawer front having a finished outer-facing surface and an inside surface for attaching to the metal bracket, the drawer front extending to or beyond the outside edges of each side rail, and extending below and above metal bracket, the drawer front having a recess formed on the inside surface, the recess extending between at least an inner edge of the two side rails;

wherein, when the first and second drawer frames are supported on cantilevered brackets connected to standards attached to a wall in predetermined positions, the drawer front attached to the first drawer frame extends downwardly from the first drawer frame a distance sufficient to cover a container of a predetermined depth when it is supported within the opening of the frame and closely fit to a top edge of the drawer front attached to the second drawer frame.

12. The wall-mounted storage system of claim 11, wherein, the drawer front attached to the second drawer frame extends up from the drawer frame a predetermined distance for closely fitting to the bottom edge of a drawer front attached to the first drawer.

13. The wall mounted storage system of claim 11, wherein the recess extends from a top edge of the drawer front to at least a top edge of the metal bracket.

14. A wall mounted storage system comprising:

a drawer frame, comprising;

two side rails that are spaced apart, each side rail having a front end and a back end;

a back rail between the two side rails connecting to the back end of each of the two side rails; and a bracket extending between and connecting each of the two side rails; and wherein the two side rails, back rail and bracket define a rectilinear shaped opening into which an open topped container may be inserted and supported by the frame; and a drawer front having a finished outer-facing surface and an inside surface for attaching to the bracket;

wherein the inner-facing surface of the drawer front has formed therein a recess extending from a top edge of the drawer front down to at least a top of the metal bracket for accommodating a lip of a container when placed within the opening, wherein the recess is at least partially hidden by the outer-facing surface of the drawer front.

15. The wall storage system of claim 14, further comprising:

two standards for mounting to a wall, each of the two standards having a plurality of predefined positions at which a cantilevered bracket may be attached;

a first pair of cantilevered brackets for mounting the drawer frame, a different one attached each of two of the two standards;

a second pair of brackets; and a shelf for mounting on the second pair of brackets, the shelf having a front apron extending from a front edge of the shelf downward a distance to at least partially cover the second pair of brackets.

16. The wall storage system of claim 14, wherein each one of the first pair of cantilevered brackets each occupies, when attached to either of the two standards, a predetermined number of the predefined positions, and each one of the second pair of cantilevered brackets occupies less than the predetermined number of predefined positions when attached to either of the at least two standards.

17. The wall storage system of claim 14, wherein, when the first pair of cantilevered brackets is connected to the two standards immediately below the second pair of brackets, the drawer frame is mounted on the first pair of brackets, and the shelf is mounted on the second pair of brackets, the drawer front extends upwardly to fit closely with a bottom edge of the apron to establish a finished appearance.

18. The wall mounted storage system of claim 14, wherein the bracket is made of metal.

19. The wall mounted storage system of claim 14, wherein the side rails are made of wood.

20. The wall mounted storage system of claim 14, wherein each of the two side rails has an inside edge, and the recess extends between the inside edge of each of the two side rails.

* * * * *